United States Patent [19]

Kanzaka

[11] 4,287,646

[45] Sep. 8, 1981

[54] AUTOMATICALLY LOCKING SLIDER FOR SLIDE FASTENER

[75] Inventor: Yoshihiro Kanzaka, Kunugiyama Nyuzen, Japan

[73] Assignee: Yoshida Kogyo, K.K., Japan

[21] Appl. No.: 10,125

[22] Filed: Feb. 7, 1979

[30] Foreign Application Priority Data

Feb. 23, 1978 [JP] Japan ..... 53-22540[U]

[51] Int. Cl.[3] ..... A44B 19/30

[52] U.S. Cl. ..... 24/205.14 R

[58] Field of Search ..... 24/205.14 R, 205.14 K, 24/205.14 A

[56] References Cited

U.S. PATENT DOCUMENTS

| | | | |
|---|---|---|---|
| 2,373,523 | 4/1945 | Winterhalter | 24/205.14 R |
| 2,502,055 | 3/1950 | Marinsky | 24/205.14 R |
| 2,512,213 | 6/1950 | Morin | 24/205.14 R |
| 3,591,901 | 7/1971 | Kedzierski | 24/205.14 R |
| 3,813,736 | 6/1974 | Fukuroi | 24/205.14 R |
| 4,123,828 | 11/1978 | Akashi | 24/205.14 R X |

FOREIGN PATENT DOCUMENTS

| | | | |
|---|---|---|---|
| 959272 | 3/1957 | Fed. Rep. of Germany | 24/205.14 R |
| 309535 | 9/1955 | Switzerland | 24/205.14 R |
| 424343 | 11/1966 | Switzerland | 24/205.14 R |

*Primary Examiner*—Roy D. Frazier
*Assistant Examiner*—Peter A. Aschenbrenner
*Attorney, Agent, or Firm*—Robert E. Burns; Emmanuel J. Lobato; Bruce L. Adams

[57] ABSTRACT

An automatically locking slider for slide fasteners includes a locking member having a locking pawl and a pivot portion, and a resilient member urging the locking member so as to cause the locking pawl to normally project into a slide fastener guide channel. The pivot portion lies substantially flat on a slider body, with its tip end loosely received in a socket carried by the slider body. Upward movement of the pivot portion is restricted, through one end portion of the resilient member, by a plug carried by a yoke attached to the slider body.

2 Claims, 5 Drawing Figures

AUTOMATICALLY LOCKING SLIDER FOR SLIDE FASTENER

BACKGROUND OF THE INVENTION

1. Field of the Invention

This invention relates to an automatically locking slider for slide fasteners.

2. Description of the Prior Art

U.S. Pat. No. 2,502,055, issued to Davis Marinsky on Mar. 28, 1950, discloses an automatically locking slider for slide fasteners. The slider essentially includes a slider body constituted by upper and lower wings connected at one end to define therebetween a generally Y-shaped guide channel, a yoke attached to the upper wing, a locking spring having its one end normally projecting into the guide channel and its other end supported on the upper wing by a socket portion of the yoke, and a pull tab operatively connected to the locking spring for retracting the one end of the locking spring away from the guide channel. The other end of the locking spring and the socket portion of the yoke are in contact with each other without any medium therebetween, and for this reason, in the case where the yoke is made of a plastic material, the socket portion of the yoke tends to be scored or otherwise worn on repeated pivotal movement of the locking spring, of which material is usually metallic. As a result, it would become difficult to effect stable locking operation of the slider fastener.

SUMMARY OF THE INVENTION

It is therefore an object of this invention to provide an automatically locking slider for slide fasteners which incorporates certain structural features such that a locking member supporting portion of a yoke made of a plastic material is protected against abrasive wear which would otherwise result from repeated direct physical engagement with a metallic locking member.

Another object of the invention is to provide an automatically locking slider for slide fasteners which is relatively simple in construction and easy to assemble.

According to this invention, an automatically locking slider for a slide fastener includes a locking member for locking the slider in position on the slide fastener. The locking member has a locking pawl at one end and a pivot portion at the other. The pivot portion of the locking member lies substantially flat on an upper wing of the slider body, with its tip end loosely received in a socket carried by the upper wing. The socket is defined by a pair of spaced side walls which prevents lateral displacement of the pivot portion. Upward movement of pivot portion is limited, through one end portion of the resilient member, by a plug carried on a yoke attached to the upper wing, the plug being fitted in the socket.

A fuller understanding of the invention will be had by referring to the following description taken in conjunction with the accompanying drawings.

DETAILED DESCRIPTION OF THE PREFERRED EMBODIMENT

Figure 1:
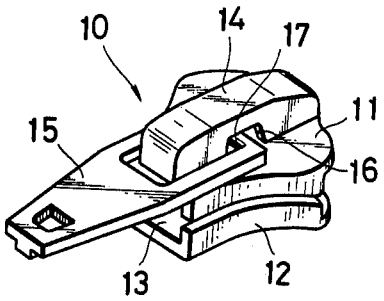
FIG. 1 is a perspective view of an automatically locking slider for slide fasteners embodying this invention.
Figure 2:
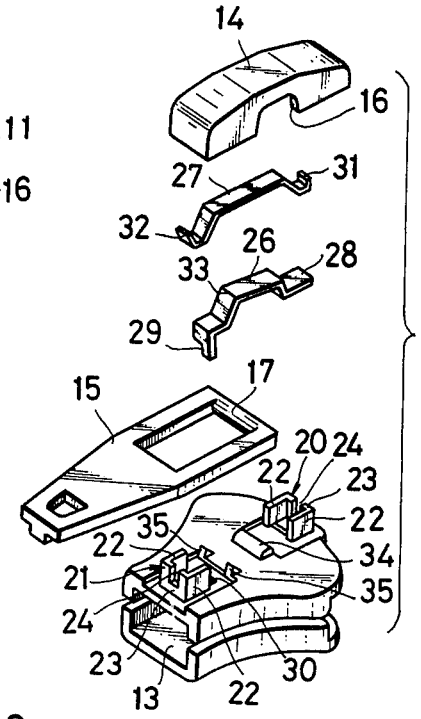
FIG. 2 is an exploded perspective view of the slider of FIG. 1.

Referring to the drawings and FIGS. 1 and 2 in particular, there is shown in a slider generally designated 10 which comprises a body constituted by upper and lower wings 11,12. The upper and lower wings 11,12 are joined at their front ends by a neck (FIGS. 4 and 5) and spaced apart in confronting relation to define therebetween a generally Y-shaped guide channel 13 for the passage of interlocking fastener element rows of a slide fastener.

Attached to the upper wing 11 is a yoke 14 to which a pull tab 15 is pivotally connected and manipulated to effect reciprocal movement of the slider 10 along the fastener element rows for closing and opening the slide fastener. The yoke 14 is in the form of a hollow cap with a transverse opening 16 through which a cross bar 17 of the pull tab 15 extends.

Figure 4:
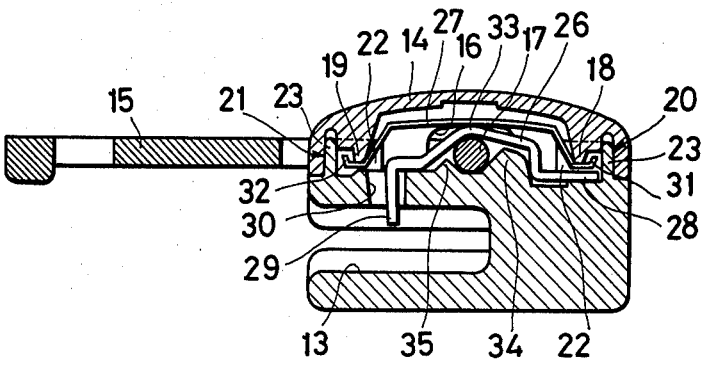
FIG. 4 is a cross-sectional view taken along the line IV—IV of FIG. 3 showing the slider in locked position.
Figure 5:
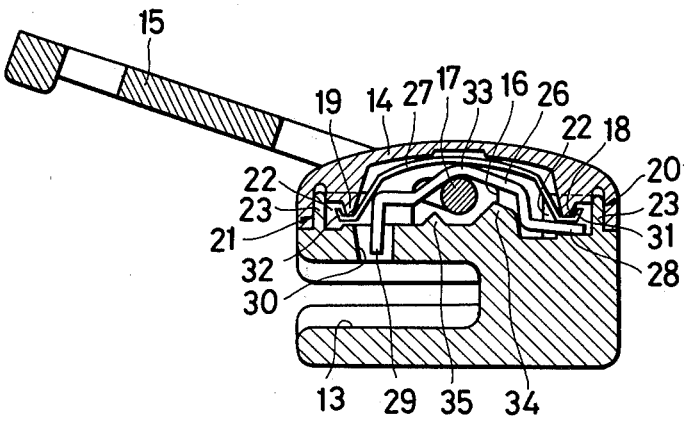
FIG. 5 is a view similar to FIG. 4 but showing the slider in unlocked position.

As best shown in FIGS. 4 and 5, the yoke 14 is provided at opposite ends with a pair of opposed first and second plugs 18,19 fitted into corresponding first and second sockets 20,21 formed in the upper wing 11, thereby securing the yoke 14 firmly in place.

Figure 3:
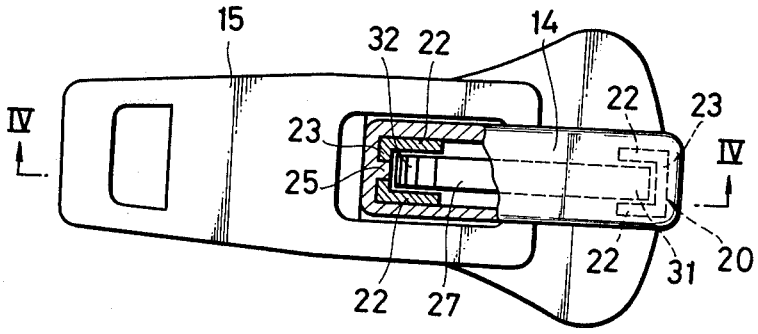
FIG. 3 is an enlarged top plan view, with parts broken away, of the slider of FIG. 1.

Each of the sockets 20,21 has a generally U-shape, as viewed from the top, defined by a pair of parallel spaced side walls 22,22 extending lengthwise of the slider body and an end wall 23 extending therebetween, with open ends of the respective sockets confronting each other. The end wall 23 has a vertical slot 24 for receiving a portion 25 (FIG. 3) of each of the plug 18,19. The slot 24 extends downwardly from the top of the end wall 23 and terminates short of the outer surface of the upper wing 11.

Means for automatically locking the slider 10 in position on the slide fastener includes a locking member 26 and a resilient member 27 operatively associated therewith.

The locking member 26 is in the form of a strip overlying the upper wing 11 across the cross bar 17 of the pull tab 15 and in concealed by the yoke 14. The locking member 26 has at one end a pivot portion 28 extending substantially in parallel to the longitudinal axis of the slider body, the pivot portion 28 being disposed in the first socket 20 across a small gap between the pivot portion 28 and the opposed side walls 22,22. Formed at the other end of the locking member 26 is a locking pawl 29 depending therefrom and adapted to move into and out of the guide channel 13 through an aperture 30 formed in the upper wing 11 at a position adjacent the second socket 21. The first plug 18 projects into the first socket 20 terminating short of the pivot portion 28 of the locking member 26.

The resilient member 27 is a leaf spring spanning between the two plugs 18,19 and having an upwardly extending projection 31,(32) at opposite ends engageable with the plug 18,(19). The resilient member 27 is thus entrapped at opposite ends by the plugs 18,19 and is depressed centrally from its underside by a crest 33 integral with the locking member 26, whereby resilient energy is stored in the resilient member 27 and which in turn urges the locking member 26 normally against the upper wing 11 and the locking pawl 29 to project into the guide channel 13 (FIGS. 4 and 5).

There are provided on the upper wing 11 a projection 34 adjacent the socket 20 and ears 35,35 adjacent the socket 21 for preventing displacement of the cross bar 17 of the pull tab 15, and that of the pivot portion 28 of the locking member 26.

FIG. 4 illustrates the slider 10 being held in locked position in which the pull tab 15 lies flat on the upper wing 11 under the influence of the resilient member 27, the locking pawl 29 of the locking member 26 projecting through the aperture 30 of the upper wing 11 into the guide channel 13 to anchor itself in the space between two adjacent fastener elements of the slide fastener. In this position, a small gap is created between the pivot portion 28 of the locking member 26 and the projecting portion 31.

FIG. 5 illustrates the slider 10 in unlocked position in which the pull tab 15 is lifted against the bias of the resilient member 27, taking the locking member 26 out of engagement with the fastener element rows of the slide fastener, thereby allowing the slider 10 to move along the fastener element rows for closing and opening the slide fastener. In this position, the gap between the pivot portion 28 and projection 31 is now filled with the pivot portion 28 of the locking member 26, a portion of the pivot portion 28 being in contact with a front surface of the projection 34.

A specific illustrative embodiment of the invention has been described. It will, of course, be appreciated however that the invention should not be limited to this specific embodiment since numerous changes and modifications may be made therein as appear obvious to one versed in the art without departing from the scope of the appended claims.

What is claimed is:

1. An automatically locking slider for a slide fastener having a pair of coupling element rows, said slider comprising:

(A) a slider body including a pair of first and second wings defining therebetween a generally Y-shaped guide channel for the passage of said pair of coupling element rows of the slide fastener, (B) a yoke attached to said first wing, (C) means attaching said yoke to said first wing, said attaching means comprising a pair of plugs on said yoke and a pair of sockets on said first wing, each of said plugs being fitted in one of said sockets respectively, (D) a locking member supported on said first wing and having at one end a locking pawl engageable with coupling element rows of the slide fastener in said guide channel and having at the other end a pivot portion disposed in one of said sockets, said locking member being pivotable about said pivot portion, (E) a resilient member urging said locking member against said first wing to cause said locking pawl normally to project into said guide channel through said aperture, and (F) a pull tab operatively connected with said locking member for pivotally moving the latter against the bias of said resilient member, to retract said locking pawl from said guide channel into said aperture, (G) said resilient member comprising a leaf spring having one end portion disposed between one of said plugs and said pivot portion of said locking member to prevent said one of said plugs from coming into contact with said pivot portion, whereby said one of said plugs is protected from abrasive wear by repeated pivotal movement of said locking member.

2. A slide according to claim 1, in which said one end portion of said leaf spring engages said one of said plugs, said pivot portion of said locking member being loosely received in a space between said one end portion of said leaf spring and said first wing.

* * * * *